US012043941B2

(12) United States Patent
Beckley

(10) Patent No.: US 12,043,941 B2
(45) Date of Patent: Jul. 23, 2024

(54) WASHING MACHINE APPLIANCE WITH SENSORLESS SPEED DETECTION AND TEMPERATURE COMPENSATION

(71) Applicant: Haier US Appliance Solutions, Inc., Wilmington, DE (US)

(72) Inventor: Bryan James Beckley, Crestwood, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 848 days.

(21) Appl. No.: 17/080,210

(22) Filed: Oct. 26, 2020

(65) Prior Publication Data

US 2022/0127773 A1 Apr. 28, 2022

(51) Int. Cl.

| | |
|---|---|
| ***D06F 34/14*** | (2020.01) |
| ***D06F 23/04*** | (2006.01) |
| *D06F 103/24* | (2020.01) |
| *D06F 103/32* | (2020.01) |
| *D06F 105/48* | (2020.01) |

(52) U.S. Cl.
CPC ..... *D06F 34/14* (2020.02); *D06F 23/04* (2013.01); *D06F 2103/24* (2020.02); *D06F 2103/32* (2020.02); *D06F 2105/48* (2020.02)

(58) Field of Classification Search
CPC ..... D06F 34/00; D06F 34/06; D06F 34/08; D06F 34/14; D06F 37/30; D06F 37/304; D06F 37/36; D06F 37/38; D06F 2103/24; D06F 2103/32; D06F 2103/44; D06F 2103/46; D06F 2105/46; D06F 2105/48
See application file for complete search history.

(56) References Cited

U.S. PATENT DOCUMENTS

2019/0305725 A1 10/2019 Whei

FOREIGN PATENT DOCUMENTS

| | | | |
|---|---|---|---|
| CN | 102591197 | A | 7/2012 |
| CN | 106521888 | B | 8/2018 |
| JP | 2018079210 | A | 5/2018 |
| KR | 101053612 | B1 | 8/2011 |

OTHER PUBLICATIONS

Machine Translation of KR 101053612 B1, Aug. 2011. (Year: 2011).*

* cited by examiner

*Primary Examiner* — David G Cormier
(74) *Attorney, Agent, or Firm* — Dority & Manning, P.A.

(57) ABSTRACT

A washing machine appliance includes a cabinet with a basket rotatably mounted within the cabinet and a motor configured to rotate the basket. The washing machine appliance also includes a controller in operative communication with the motor to regulate a speed of the motor. The controller may be configured for, and methods of operating the washing machine appliance may include, activating the motor to rotate the basket at a rotational speed within a predetermined speed range and measuring the rotational speed of the basket with the controller. The controller may also be configured for, and the method may also include, monitoring an ambient temperature inside the cabinet of the washing machine appliance and applying an offset to the measured rotational speed when the monitored ambient temperature exceeds a threshold.

18 Claims, 4 Drawing Sheets

WASHING MACHINE APPLIANCE WITH SENSORLESS SPEED DETECTION AND TEMPERATURE COMPENSATION

FIELD OF THE INVENTION

The present subject matter relates generally to washing machine appliances and methods for monitoring speed of a rotating basket in a washing machine appliance.

BACKGROUND OF THE INVENTION

Washing machine appliances generally include a tub with a basket rotatably positioned within the tub. Articles to be washed, such as clothes, are placed in the machine's basket. A motor may be mechanically coupled to the basket and/or an agitation element disposed within the basket, such as by a direct drive or a belt and pulley, for rotation of the basket and/or agitation element. At various points in the operation of the washing machine, the basket and/or agitation element can rotate to move articles within the basket to facilitate washing. For example, the basket and/or agitation element may be rotated during a rinse cycle of the washing machine appliance to facilitate distributing rinse fluid evenly on articles within the basket.

As another example, the basket and/or agitation element may be rotated during an agitation operation of the washing machine appliance. Such rotation during the agitation operation may include oscillation, e.g., rotating in a first direction, stopping, then rotating in the opposite direction. When rotating the basket and/or agitation element, the heat of the drive motor may rise.

Washing machine appliances typically measure the speed of rotation of the basket in order to ensure the speed stays below a predetermined limit. Some washing machine appliances include dedicated sensors for measuring the rotational speed, which can result in increased cost and complexity to the washing machine appliance. Other washing machines eliminate the dedicated sensor, but this results in less accurate speed measurement.

Accordingly, a washing machine appliance with features for accurately measuring rotational speed of a basket in the washing machine without a dedicated speed sensor would be useful.

BRIEF DESCRIPTION OF THE INVENTION

Aspects and advantages of the invention will be set forth in part in the following description, or may be obvious from the description, or may be learned through practice of the invention.

In one aspect of the present disclosure, a method of operating a washing machine appliance is provided. The washing machine appliance includes a cabinet, a basket rotatably mounted within the cabinet, a motor configured to rotate the basket, and a controller in operative communication with the motor to regulate a speed of the motor. The method includes activating the motor to rotate the basket at a rotational speed within a predetermined speed range and measuring the rotational speed of the basket with the controller. The method also includes monitoring an ambient temperature inside the cabinet of the washing machine appliance with the controller and applying an offset to the measured rotational speed when the monitored ambient temperature exceeds a threshold.

In another aspect of the present disclosure, a washing machine appliance is provided. The washing machine appliance includes a cabinet with a basket rotatably mounted within the cabinet and a motor configured to rotate the basket. The washing machine appliance also includes a controller in operative communication with the motor to regulate a speed of the motor. The controller is configured for activating the motor to rotate the basket at a rotational speed within a predetermined speed range and measuring the rotational speed of the basket with the controller. The controller is also configured for monitoring an ambient temperature inside the cabinet of the washing machine appliance and applying an offset to the measured rotational speed when the monitored ambient temperature exceeds a threshold.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
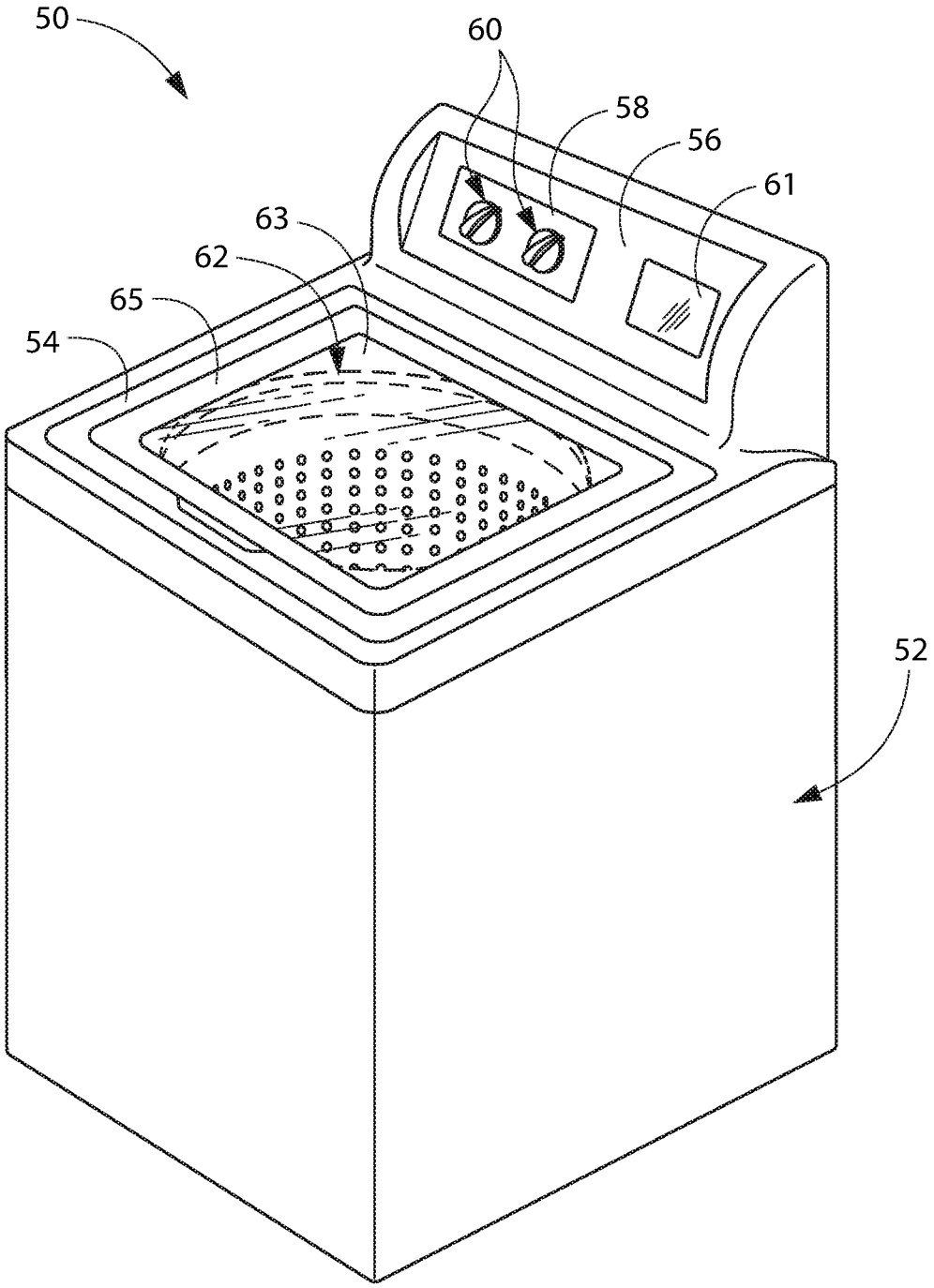
FIG. 1 provides a perspective view of a laundry appliance in accordance with one or more example embodiments of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, terms of approximation, such as "generally," or "about" include values within ten percent greater or less than the stated value. When used in the context of an angle or direction, such terms include within ten degrees greater or less than the stated angle or direction. For example, "generally vertical" includes directions within ten degrees of vertical in any direction, e.g., clockwise or counter-clockwise.

As used herein, the terms "articles," "clothing," or "laundry" include but need not be limited to fabrics, textiles, garments, linens, papers, or other items which may be cleaned and/or treated in a washing machine appliance. Furthermore, the term "load" or "laundry load" refers to the combination of clothing that may be washed together in a washing machine appliance or dried together in a dryer appliance (e.g., clothes dryer) and may include a mixture of different or similar articles of clothing of different or similar types and kinds of fabrics, textiles, garments and linens within a particular laundering process.

FIG. 1 is a perspective view of a washing machine appliance 50 according to an exemplary embodiment of the present subject matter. As may be seen in FIG. 1, washing machine appliance 50 includes a cabinet 52 and a cover 54. A backsplash 56 extends from cover 54, and a control panel 58, including a plurality of input selectors 60, is coupled to backsplash 56.

Control panel 58 and input selectors 60 collectively form a user interface input for operator selection of machine cycles and features, and in one embodiment, a display 61 indicates selected features, a countdown timer, and/or other items of interest to machine users. It should be appreciated, however, that in other exemplary embodiments, the control panel 58, input selectors 60, and display 61, may have any other suitable configuration. For example, in other exemplary embodiments, one or more of the input selectors 60 may be configured as manual "push-button" input selectors, or alternatively may be configured as a touchscreen on, e.g., display 61.

A lid 62 is mounted to cover 54 and is rotatable between an open position (not shown) facilitating access to a tub, also referred to as a wash tub, 64 (FIG. 2) located within cabinet 52 and a closed position (shown in FIG. 1) forming an enclosure over tub 64. Lid 62 in exemplary embodiment includes a transparent panel 63, which may be formed of, for example, glass, plastic, or any other suitable material. The transparency of the panel 63 allows users to see through the panel 63, and into the tub 64 when the lid 62 is in the closed position. In some embodiments, the panel 63 may itself generally form the lid 62. In other embodiments, the lid 62 may include the panel 63 and a frame 65 surrounding and encasing the panel 63. Alternatively, panel 63 need not be transparent.

Figure 2:
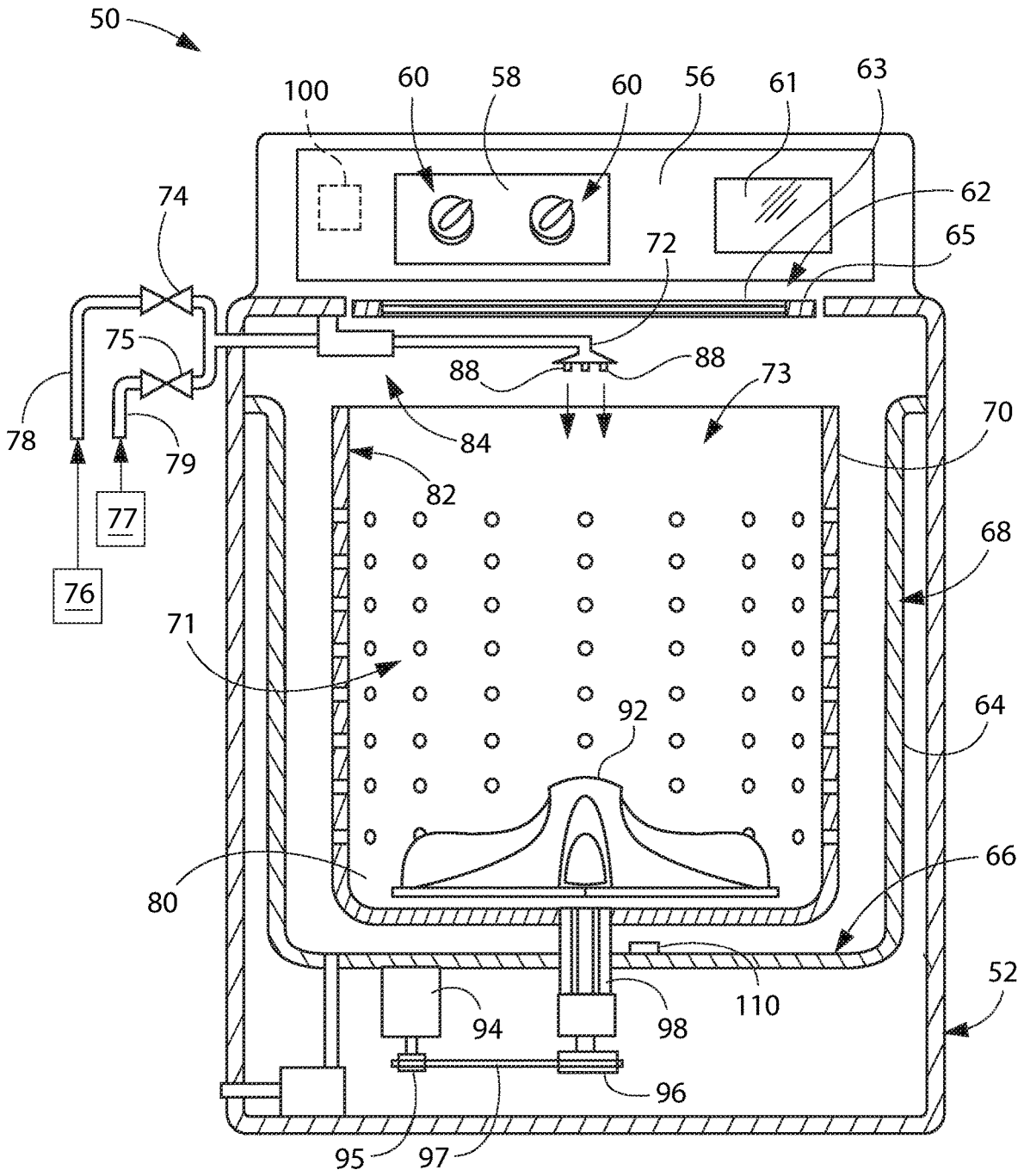
FIG. 2 provides a front, section view of the exemplary laundry appliance of FIG. 1.

FIG. 2 provides a front, cross-section view of the exemplary washing machine appliance 50 of FIG. 1. As may be seen in FIG. 2, tub 64 includes a bottom wall 66 and a sidewall 68. A wash drum or basket 70 is rotatably mounted within tub 64. In particular, basket 70 is rotatable about a vertical axis V. Thus, washing machine appliance is generally referred to as a vertical axis washing machine appliance. Basket 70 defines a wash chamber 73 for receipt of articles for washing and extends, e.g., vertically, between a bottom portion 80 and a top portion 82. Basket 70 includes a plurality of openings or perforations 71 therein to facilitate fluid communication between an interior of basket 70 and tub 64.

A nozzle 72 is configured for flowing a liquid into tub 64. In particular, nozzle 72 may be positioned at or adjacent to top portion 82 of basket 70. Nozzle 72 may be in fluid communication with one or more water sources 76, 77 in order to direct liquid (e.g. water) into tub 64 and/or onto articles within chamber 73 of basket 70. Nozzle 72 may further include apertures 88 through which water may be sprayed into the tub 64. Apertures 88 may, for example, be tubes extending from the nozzles 72 as illustrated, or simply holes defined in the nozzles 72 or any other suitable openings through which water may be sprayed. Nozzle 72 may additionally include other openings, holes, etc. (not shown) through which water may be flowed, i.e., sprayed or poured, into the tub 64.

Various valves may regulate the flow of fluid through nozzle 72. For example, a flow regulator may be provided to control a flow of hot and/or cold water into the wash chamber of washing machine appliance 50. For the embodiment depicted, the flow regulator includes a hot water valve 74 and a cold water valve 75. The hot and cold water valves 74, 75 are utilized to flow hot water and cold water, respectively, therethrough. Each valve 74, 75 can selectively adjust to a closed position in order to terminate or obstruct the flow of fluid therethrough to nozzle 72. The hot water valve 74 may be in fluid communication with a hot water source 76, which may be external to the washing machine appliance 50. The cold water valve 75 may be in fluid communication with a cold water source 77, which may be external to the washing machine appliance 50. The cold water source 77 may, for example, be a commercial water supply, while the hot water source 76 may be, for example, a water heater. Such water sources 76, 77 may supply water to the appliance 50 through the respective valves 74, 75. A hot water conduit 78 and a cold water conduit 79 may supply hot and cold water, respectively, from the sources 76, 77 through the respective valves 74, 75 and to the nozzle 72.

An additive dispenser 84 may additionally be provided for directing a wash additive, such as detergent, bleach, liquid fabric softener, etc., into the tub 64. For example, dispenser 84 may be in fluid communication with nozzle 72 such that water flowing through nozzle 72 flows through dispenser 84, mixing with wash additive at a desired time during operation to form a liquid or wash fluid, before being flowed into tub 64. For the embodiment depicted, nozzle 72 is a separate downstream component from dispenser 84. In other exemplary embodiments, however, nozzle 72 and dispenser 84 may be integral, with a portion of dispenser 84 serving as the nozzle 72, or alternatively dispenser 84 may be in fluid communication with only one of hot water valve 74 or cold water valve 75. In still other exemplary embodiments, the washing machine appliance 50 may not include a dispenser, in which case a user may add one or more wash additives directly to wash chamber 73. A pump assembly 90 (shown schematically in FIG. 2) is located beneath tub 64 and basket 70 for gravity assisted flow to drain tub 64.

In some embodiments, for example as illustrated in FIG. 2, an agitation element 92 may be provided and may be oriented to rotate about the vertical direction V. As illustrated in FIG. 2, the basket 70 and agitation element 92 are driven by a motor 94, such as an induction motor, which is mechanically coupled to the basket 70. The motor may be mechanically coupled to the basket 70, e.g., via a drive pulley 95, a basket pulley 96, and a belt 97 as illustrated in FIG. 2. When the motor 94 is activated, the motor 94 rotates the drive pulley 95 and such rotation is transferred via the belt 97 to the basket pulley 96 which is joined to a motor output shaft 98. The basket pulley 96 may be integrally joined to the motor output shaft 98 or may be otherwise joined in any suitable manner. As motor output shaft 98 is rotated, basket 70 and agitation element 92 are operated for rotatable movement within tub 64, e.g., about vertical axis V. In other embodiments, the belt 97 may be directly connected to the basket 70, e.g., in a horizontal axis washing machine appliance. In additional exemplary embodiments, the motor may be mechanically coupled to the basket 70 and/or agitation element 92 without any belts or pulleys using a direct drive assembly. Various other forms of mechanical coupling may also be provided, such as via a mode shifter which selectively transfers rotation from the motor 94 to the basket 70 or the agitator 92. Such forms of mechanical coupling, e.g., a direct drive and/or mode shifter, are understood by those of skill in the art and, as such, are not illustrated in detail.

Various sensors may additionally be included in the washing machine appliance 50. For example, a pressure sensor 110 may be positioned in the tub 64 as illustrated or, alternatively, may be remotely mounted in another location within the appliance 50 and be operationally connected to tub 64 by a hose (not shown). Any suitable pressure sensor 110, such as an electronic sensor, a manometer, or another suitable gauge or sensor, may be utilized. The pressure sensor 110 may generally measure the pressure of water in the tub 64. This pressure can then be utilized to estimate the height or amount of water in the tub 64. Additionally, a suitable speed sensor can be connected to the motor 94, such as to the output shaft 98 thereof, to measure speed and indicate operation of the motor 94. Other suitable sensors, such as temperature sensors, water/moisture sensors, etc., may additionally be provided in the washing machine appliance 50.

Operation of washing machine appliance 50 is controlled by a processing device or controller 100, that is operatively coupled to the input selectors 60 located on washing machine backsplash 56 (shown in FIG. 1) for user manipulation to select washing machine cycles and features. Controller 100 may further be operatively coupled to various other components of appliance 50, such as the flow regulator (including valves 74, 75), motor 94, pressure sensor 110, speed sensor, other suitable sensors, etc. In response to user manipulation of the input selectors 60, controller 100 may operate the various components of washing machine appliance 50 to execute selected machine cycles and features.

Controller 100 is a "processing device" or "controller" and may be embodied as described herein. As used herein, "processing device" or "controller" may refer to one or more microprocessors, microcontroller, application-specific integrated circuits (ASICS), or semiconductor devices and is not restricted necessarily to a single element. The controller 100 may be programmed to operate washing machine appliance 50 by executing instructions stored in memory. The controller may include, or be associated with, one or more memory elements such as for example, RAM, ROM, or electrically erasable, programmable read only memory (EEPROM). For example, the instructions may be software or any set of instructions that when executed by the processing device, cause the processing device to perform operations. Controller 100 can include one or more processor(s) and associated memory device(s) configured to perform a variety of computer-implemented functions and/or instructions (e.g. performing the methods, steps, calculations and the like and storing relevant data as disclosed herein). It should be noted that controllers 100 as disclosed herein are capable of and may be operable to perform any methods and associated method steps as disclosed herein.

While described in the context of specific embodiments of washing machine appliance 50, using the teachings disclosed herein it will be understood that washing machine appliance 50 is provided by way of example only. Other laundry appliances having different configurations (such as horizontal-axis washing machine appliances, or various clothes dryer appliances), different appearances, and/or different features may also be utilized with the present subject matter as well.

Figure 3:
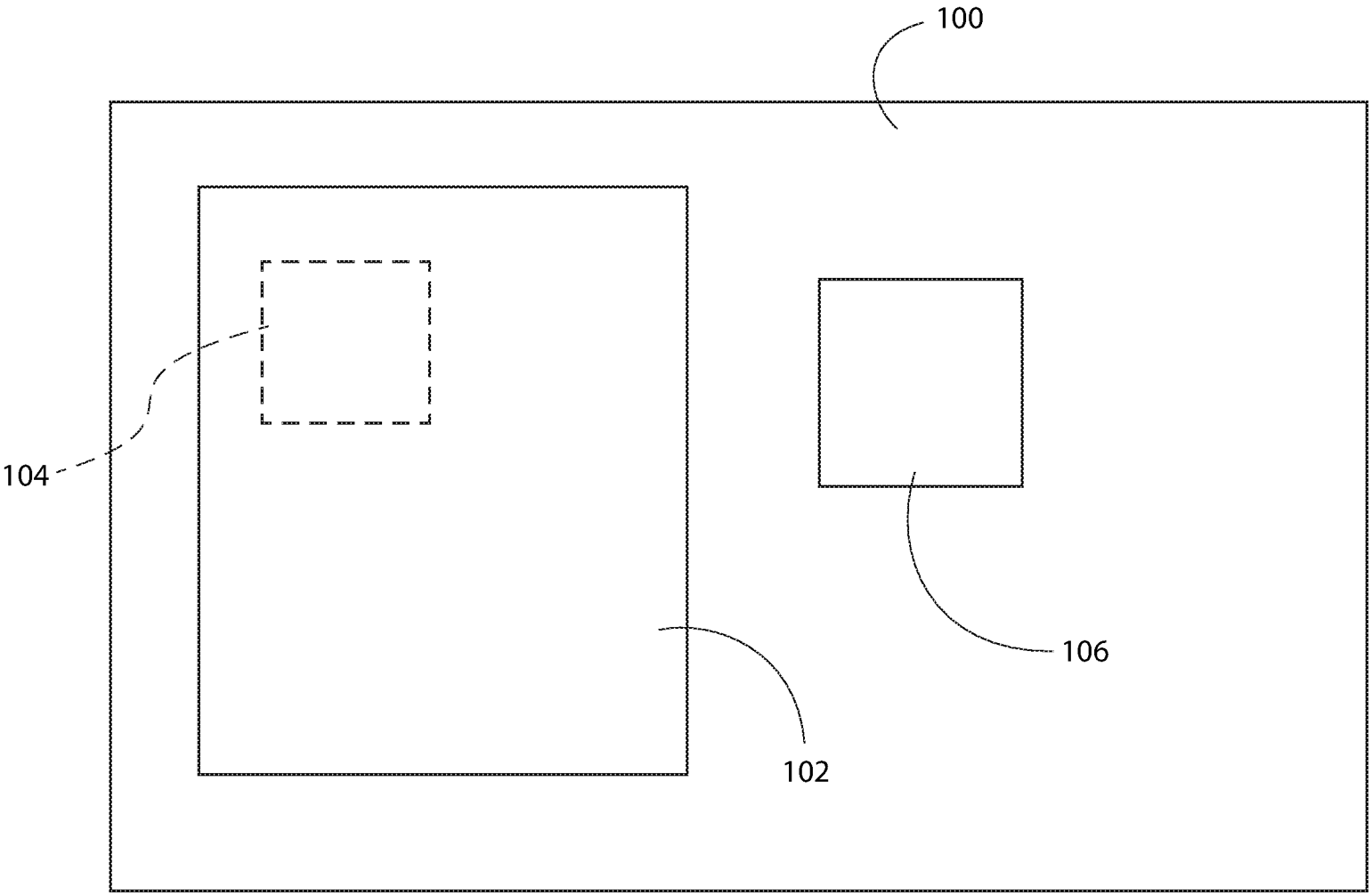
FIG. 3 provides a schematic illustration of a controller for a laundry appliance in accordance with one or more example embodiments of the present disclosure.

FIG. 3 provides a schematic illustration of a controller 100 which may be incorporated into the washing machine appliance 50 in some embodiments of the present subject matter. As illustrated in FIG. 3, the controller 100 includes an intelligent power module 102. The intelligent power module 102 includes a thermistor 104 therein. The thermistor 104 may, for example, be embedded in the intelligent power module 102 to measure temperatures that the controller 100 is exposed to, such as heatsink temperatures. Also as may be seen in FIG. 3, the controller 100 further includes an internal oscillator 106. The oscillator 106 may have a variable frequency. The oscillator 106 may provide a clock function to the controller 100. For example, in some embodiments, the controller 100 may be configured to measure rotational speed of the basket 70, such as by tracking the current drawn by the motor 94 and calculating the rotational speed based on the drawn current and with reference to the speed or frequency of the oscillator 106. In some embodiments, the current drawn by the motor 94 may be measured or determined using a plurality of shunt resistors, e.g., three shunt resistors, to measure a voltage drop which correlates to a rate of change in current. For example, the speed or frequency of the oscillator 106 may be used, e.g., referenced, to determine the time component or time factor in the speed calculation. However, the frequency of the oscillator 106 may drift when the temperature increases, which can lead to less accurate calculations of the rotational speed of the basket 70. Thus, as will be described in more detail below, an offset may be applied to the calculated speed to account for the frequency drift of the oscillator 106 when the ambient temperature is above a certain limit.

Embodiments of the present disclosure include methods of operating a washing machine appliance. One example of such embodiments is the method 300 illustrated in FIG. 4. Method 300 can be used to operate any suitable washing machine appliance, such as washing machine appliance 50 (FIG. 1), for example. In some embodiments, method 300 may be programmed into and implemented by controller 100 (FIG. 2) of washing machine appliance 50.

Figure 4:
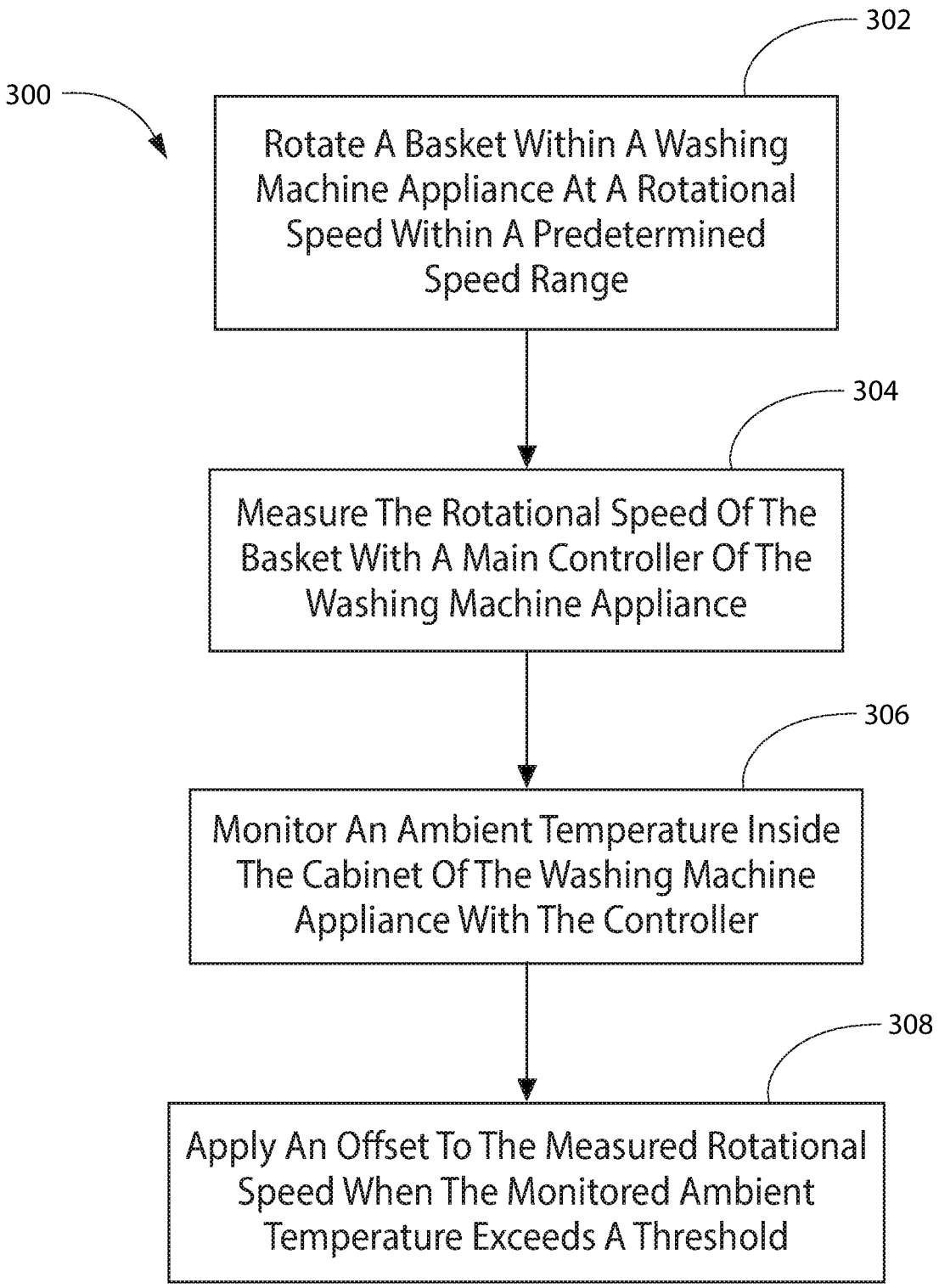
FIG. 4 provides a flow chart illustrating a method of operating a washing machine appliance in accordance with one or more example embodiments of the present disclosure.

As shown in FIG. 4, the method 300 may include a step 302 of rotating a basket of the washing machine appliance, such as by activating a motor coupled to the basket to rotate the basket, at a rotational speed within a predetermined speed range. The predetermined speed range may include an upper limit and, in some embodiments, the method 300 may include decelerating the basket when a measured rotational speed of the basket (see, e.g., step 304 in FIG. 4, as explained below) exceeds the upper limit of the predetermined range. In some instances, e.g., when an ambient temperature within the washing machine appliance is above a threshold, the measured rotational speed of the basket that is compared with the upper limit of the predetermined range may be the measured rotational speed after applying an offset. Applying the offset to the measured rotational speed before using the speed measurement to determine whether to decelerate the basket may avoid or reduce false positives, e.g., decelerating the rotation of the basket unnecessarily.

Also as shown in FIG. 4, the method 300 may further include a step 304 of measuring the rotational speed of the basket with the controller. In particular, the rotational speed may be directly measured by the controller, such as without using a speed sensor and the washing machine appliance may, in some embodiments, not include a speed sensor. For example, measuring the rotational speed of the basket may include measuring a voltage drop, e.g., across the motor, with a plurality of shunt resistors. The structure and function of shunt resistors are understood by those of ordinary skill in the art and, as such, are not illustrated or described in further detail herein for the sake of concision and clarity. In such embodiments, measuring the rotational speed of the basket may further include correlating the measured voltage drop with a rate of change in current, e.g., drawn by the motor, and determining the rotational speed of the basket based on the rate of change in current with reference to the speed of the internal oscillator of the controller.

Still with reference to FIG. 4, the method 300 may also include a step 306 of monitoring an ambient temperature inside the cabinet of the washing machine appliance with the controller. For example, the ambient temperature inside the cabinet of the washing machine appliance may, in some embodiments, be monitored, e.g., measured repeatedly or continuously, with a thermistor on board the controller, such as a thermistor embedded in an intelligent power module of the controller. In some embodiments, the ambient temperature inside the cabinet of the washing machine may be a temperature outside of the basket, e.g., the measured temperature may not be or correspond to a temperature of wash liquid and/or articles within the basket. For example, in embodiments where the controller is positioned within a backsplash of the washing machine appliance, the measured temperature may be the ambient temperature within the backsplash.

In some embodiments, e.g., as illustrated at 308 in FIG. 4, the method 300 may also include applying an offset to the measured rotational speed when the monitored ambient temperature exceeds a threshold. For example, the offset may be based on a drift of frequency of the internal oscillator of the controller, whereby the offset is based on, e.g., proportional to, the frequency drift based on the correlation of the drift and the measured ambient temperature.

In some embodiments, the method may dynamically compensate the oscillator frequency based on the input temperature, thereby optimizing the accuracy of the current-based speed algorithms. For example, the offset may be a first offset and the threshold may be a first threshold, and the method 300 may further include applying a second offset greater than the first offset when the monitored ambient temperature exceeds a second threshold greater than the first threshold. For example, the frequency drift may vary linearly with temperature over a first temperature range, e.g., between the first threshold and the second threshold the frequency drift may vary at a constant rate as temperature increases, whereas the rate of frequency drift may increase when the ambient temperature is above the second threshold. Thus, the first offset may account for the drift when the ambient temperature is within the first temperature range and the second offset may account for the frequency drift when the ambient temperature is above the second threshold.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A method of operating a washing machine appliance, the washing machine appliance comprising a cabinet, a basket rotatably mounted within the cabinet, a motor configured to rotate the basket, and a controller in operative communication with the motor to regulate a speed of the motor, the method comprising:

activating the motor to rotate the basket at a rotational speed;

measuring the rotational speed of the basket with the controller;

monitoring an ambient temperature inside the cabinet of the washing machine appliance with the controller; and applying an offset to the measured rotational speed when the monitored ambient temperature exceeds a threshold.

2. The method of claim 1, wherein measuring the rotational speed of the basket comprises measuring the rotational speed of the basket with reference to a speed of an internal oscillator of the controller.

3. The method of claim 2, wherein measuring the rotational speed of the basket further comprises measuring a voltage drop with a plurality of shunt resistors, correlating the measured voltage drop with a rate of change in current, and determining the rotational speed of the basket based on the rate of change in current with reference to the speed of the internal oscillator of the controller.

4. The method of claim 1, wherein the ambient temperature inside the cabinet of the washing machine is measured with a thermistor on board the controller.

5. The method of claim 4, wherein the thermistor on board the controller is part of an intelligent power module.

6. The method of claim 1, further comprising comparing the measured rotational speed of the basket with a predetermined speed range and decelerating the basket when the measured rotational speed exceeds the upper limit of the predetermined speed range.

7. The method of claim 1, wherein the offset is a first offset and the threshold is a first threshold, further comprising applying a second offset greater than the first offset when the monitored ambient temperature exceeds a second threshold greater than the first threshold.

8. The method of claim 1, wherein the ambient temperature inside the cabinet of the washing machine is outside of the basket.

9. The method of claim 1, wherein the washing machine appliance further comprises a backsplash, the controller positioned within the backsplash, and wherein the ambient temperature inside the cabinet of the washing machine is the ambient temperature within the backsplash.

10. A washing machine appliance, comprising:

a cabinet;

a basket rotatably mounted within the cabinet;

a motor configured to rotate the basket; and a controller in operative communication with the motor to regulate a speed of the motor, wherein the controller is configured for:

activating the motor to rotate the basket at a rotational speed;

measuring the rotational speed of the basket with the controller;

monitoring an ambient temperature inside the cabinet of the washing machine appliance with the controller; and applying an offset to the measured rotational speed when the monitored ambient temperature exceeds a threshold.

11. The washing machine appliance of claim 10, wherein measuring the rotational speed of the basket comprises measuring the rotational speed of the basket with reference to a speed of an internal oscillator of the controller.

12. The washing machine appliance of claim 11, wherein measuring the rotational speed of the basket further comprises measuring a voltage drop with a plurality of shunt resistors, correlating the measured voltage drop with a rate of change in current, and determining the rotational speed of the basket based on the rate of change in current with reference to the speed of the internal oscillator of the controller.

13. The washing machine appliance of claim 10, wherein the ambient temperature inside the cabinet of the washing machine is measured with a thermistor on board the controller.

14. The washing machine appliance of claim 13, wherein the thermistor on board the controller is part of an intelligent power module.

15. The washing machine appliance of claim 10, further comprising comparing the measured rotational speed of the basket with a predetermined speed range and decelerating the basket when the measured rotational speed exceeds the upper limit of the predetermined speed range.

16. The washing machine appliance of claim 10, wherein the offset is a first offset and the threshold is a first threshold, further comprising applying a second offset greater than the first offset when the monitored ambient temperature exceeds a second threshold greater than the first threshold.

17. The washing machine appliance of claim 10, wherein the ambient temperature inside the cabinet of the washing machine is outside of the basket.

18. The washing machine appliance of claim 10, further comprising a backsplash, the controller positioned within the backsplash, and wherein the ambient temperature inside the cabinet of the washing machine is the ambient temperature within the backsplash.

* * * * *